United States Patent [19]

Miller

[11] 4,093,406

[45] June 6, 1978

[54] FLUID OPERATED HYDRAULIC PUMP INCLUDING NOISE REDUCTION MEANS

[75] Inventor: Douglas P. Miller, Milwaukee, Wis.

[73] Assignee: Applied Power Inc., Milwaukee, Wis.

[21] Appl. No.: 717,761

[22] Filed: Aug. 25, 1976

[51] Int. Cl.[2] ..... F04B 17/00; F01N 3/06; F01N 1/08

[52] U.S. Cl. ..... 417/401; 181/230; 181/265

[58] Field of Search ..... 417/312, 399, 401, 402; 181/57, 69, 230, 265, 274, 270, 268

[56] References Cited

U.S. PATENT DOCUMENTS

| | | | |
|---|---|---|---|
| 1,246,196 | 11/1917 | Weisberg | 181/268 |
| 1,342,464 | 6/1920 | Sawder et al. | 181/57 |
| 1,997,298 | 4/1935 | Hathorn | 181/57 |
| 2,062,141 | 11/1936 | Newman | 181/265 |
| 2,244,060 | 6/1941 | Fuehrer | 181/230 |
| 3,041,975 | 7/1962 | Atherton et al. | 417/434 |
| 3,197,127 | 7/1965 | Valbjorn | 417/312 |
| 3,332,504 | 7/1967 | Lowery | 181/69 |
| 3,788,781 | 1/1974 | McClocklin | 417/401 |
| 3,802,804 | 4/1974 | Zimmermann | 417/360 |

FOREIGN PATENT DOCUMENTS

| | | | |
|---|---|---|---|
| 1,391,951 | 2/1965 | France | 181/268 |

*Primary Examiner*—Carlton R. Croyle
*Assistant Examiner*—Thomas I. Ross
*Attorney, Agent, or Firm*—James E. Nilles

[57] ABSTRACT

A fluid operated hydraulic pump of the type using air pressure to produce high pressure hydraulic fluid wherein an air pressure driven motor and a hydraulic pump are positioned in adjacent axially aligned relationship and the air motor includes a reciprocating piston which drives the hydraulic pump. The air motor includes an exhaust passage having an expansion chamber therein for receiving exhaust air flow and including a plurality of baffles therein, the expansion chamber and the baffles functioning in combination to reduce the noise generated by the air motor without the use of other muffling material thereby avoiding undue back pressure in the air motor and increasing the speed and efficiency and operation of the air motor and the pump.

3 Claims, 10 Drawing Figures

FLUID OPERATED HYDRAULIC PUMP INCLUDING NOISE REDUCTION MEANS

BACKGROUND OF THE INVENTION

The present invention relates generally to improvements in fluid driven hydraulic pumps and more particularly to improvements in fluid driven motors used in such hydraulic pumps to drive the hydraulic pumps.

Fluid actuated hydraulic fluid pressure producing units are shown, for example, in U.S. Pat. No. 3,041,975, issued July 3, 1962 to Atherton et al. and in U.S. Pat. No. 3,463,053, issued Aug. 26, 1969 to Leibundgut, both of these patents being assigned to the assignee in common with that of the present invention.

Fluid actuated hydraulic power units of the type referred to in the above patents are generally intended to use a source of air pressure, such as that commonly available in garages or in industrial applications, and which produce air pressure on the order of 100 psi, to supply high pressure hydraulic fluid at pressures on the order of 10,000 psi to operate hydraulic fluid motors or other hydraulic tools. Such hydraulic power units include a reciprocating piston air motor wherein the piston is driven by the compressed air supplied to the air motor and wherein the piston is functional to reciprocate a piston of a hydraulic pump to thereby drive the hydraulic pump and supply high pressure hydraulic fluid through an output passage to a hydraulic tool or the like.

During the operation of such power units, air flows through the air motors at relatively high velocities and as a result, unrestricted air flow through such power units generates a substantial amount of noise. The prior art apparatus has included muffling devices such as muffling materials placed in the exhaust passages of the power units in order to reduce the noise generated by the fluid motors. However, use of muffling materials generates back pressure in the fluid motor thereby decreasing its efficiency of operation and also functioning to reduce the speed of the fluid motor.

SUMMARY OF THE INVENTION

The present invention provides an improved fluid motor for use in a fluid driven hydraulic pump unit which includes an improved means for reducing the noise generated by the fluid motor without reducing the efficiency of operation of the fluid motor and without decreasing the speed of the fluid motor.

The fluid motor of the present invention includes an exhaust passage extending between the motor chamber and the ambient atmosphere, the exhaust passage including an expansion chamber which facilitates expansion of the fluid being exhausted from the motor chamber whereby the velocity of this fluid is reduced and the noise level produced thereby consequently diminished. The expansion chamber also includes a plurality of baffles comprising planar vanes which extend into the expansion chamber to control the flow of fluid through the expansion chamber and further reducing the noise generated by the exhaust flow. The air motor also includes a substantial number of narrow passages extending between the expansion chamber and the ambient atmosphere to provide for fluid communication therebetween, the plurality of narrow passages functioning to prevent high velocity fluid flow from the air motor thereby cutting down the operating noise level of the fluid motor.

Further advantages of the present invention will be apparent from the following description of a preferred embodiment of the invention.

DESCRIPTION OF THE PREFERRED EMBODIMENT

Figure 2:
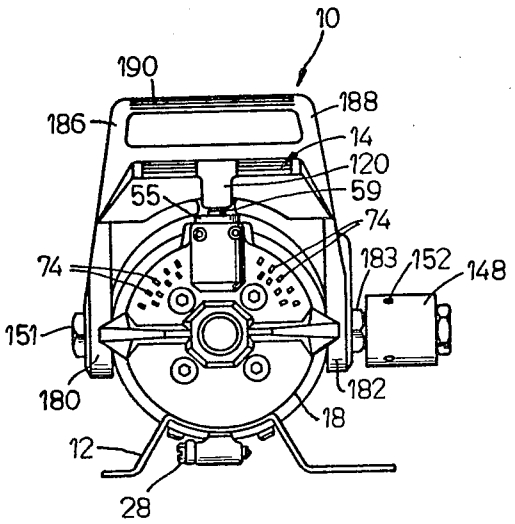
FIG. 2 is an end elevation view of the power unit shown in FIG. 1.

Referring to the drawings, the power unit shown therein as embodying the invention comprises, in general, a unitary body 10 supported by a base 12 and having an actuating lever or treadle 14 pivoted thereon. The body 10 includes a fluid or air motor portion 16 closed at one end by an air motor valve block 18 and having a hydraulic reservoir housing 20 extending from its opposite end and a hydraulic pump valve block 22 interposed between the air motor 16 and the hydraulic reservoir housing 20. The body 10 is of generally cylindrical shape, and the air motor portion 16, air motor valve block 18, hydraulic reservoir housing 20, and hydraulic pump valve block 22 are in axial alignment. The air motor 16 and the air motor valve block 18 are shown as being comprised from plastic and can be advantageously formed by injection molding, however, a plurality of other materials such as die cast aluminum could be used. The air motor 16 is secured to the hydraulic pump valve block 22 by a restraining band 24 which can be received around an end portion 17 of air motor 16 whereby that end of the plastic air motor can be clamped against a projecting annular end 26 of the hydraulic valve block 22 by means of a tightening screw 28. The hydraulic reservoir housing 20 is comprised in part of a cylindrical sleeve 21 which includes an open end which is received around an end 27 of the hydraulic valve block 22 and secured thereto by screws 30.

Live air or other pressurized fluid from a suitable source 32 (FIG. 3) is admitted through a conduit 33 to the air motor valve block 18 by means of an air inlet coupling 34, which is threadably received within a bore 35 in the valve block 18, and high pressure hydraulic fluid is discharged from the hydraulic pump valve block 22 through a high pressure pump outlet swivel coupling 36.

Air Motor

Referring to the air motor 16 and air motor valve block 18 shown in FIGS. 3–7, air from the supply source 32 is intended to pass through the air inlet coupling 34 and through an air filter 38 threadably journalled therein and within the bore 35. The flow of air through the air inlet coupling 34 is governed by a check valve poppet 40 which includes a flange 42 at one end receivable against a valve seat 44 (FIG. 4) to prevent fluid flow into the air motor. The check valve poppet 40 is axially slideably supported in an axial bore 46 in the air motor valve block 18 and is co-axial with the longitudinal axis of the air motor 16, hydraulic reservoir housing 20, and hydraulic valve block 22, and the axial position of the check valve poppet 40 is governed by a spring biased shuttle valve 48 as will be described hereinafter. When the check valve poppet 40 is in a position to permit air flow into the bore 46 (FIG. 3), the air will then flow through a supply passage 50 (FIG. 5) in the air valve block 18 to a cylindrical bore 52 housing an actuating throttle valve assembly 54. The actuating throttle valve assembly 54 is slideably received in the bore 52 and fluid-tight relationship is maintained by resilient O-ring seals 56. The actuating throttle valve assembly 54 includes a generally cylindrical valve body 55 and a slideable throttle valve poppet 57 which is axially movable within a bore 58 in the valve body 55 and which includes a flange 60 at one end normally seated against a valve seat 62 of the valve body 55 and biased toward a fluid flow restricting position by air pressure in the supply passage 50. The valve body 55 also includes a port 64 therethrough in open communication with the axial bore 58 in the valve body 55 and intended to facilitate air flow through an axial supply passage 66 in the air valve block 18 and air motor 16 whereby air can be supplied to the air motor displacement chamber 68.

The air motor portion 16 also includes an axially aligned stepped cylindrical valve chamber 70 adjacent its end wall 71, the valve chamber 70 being defined in part by a cylindrical bore in an axial projection 72 of the air motor portion 16 and which is receivable in fluid tight relationship within the air motor valve block 18. The valve chamber 70 slideably houses the shuttle valve poppet 48 which is in turn functional to permit exhaust from the chamber 68 into the valve chamber 70.

Figure 7:
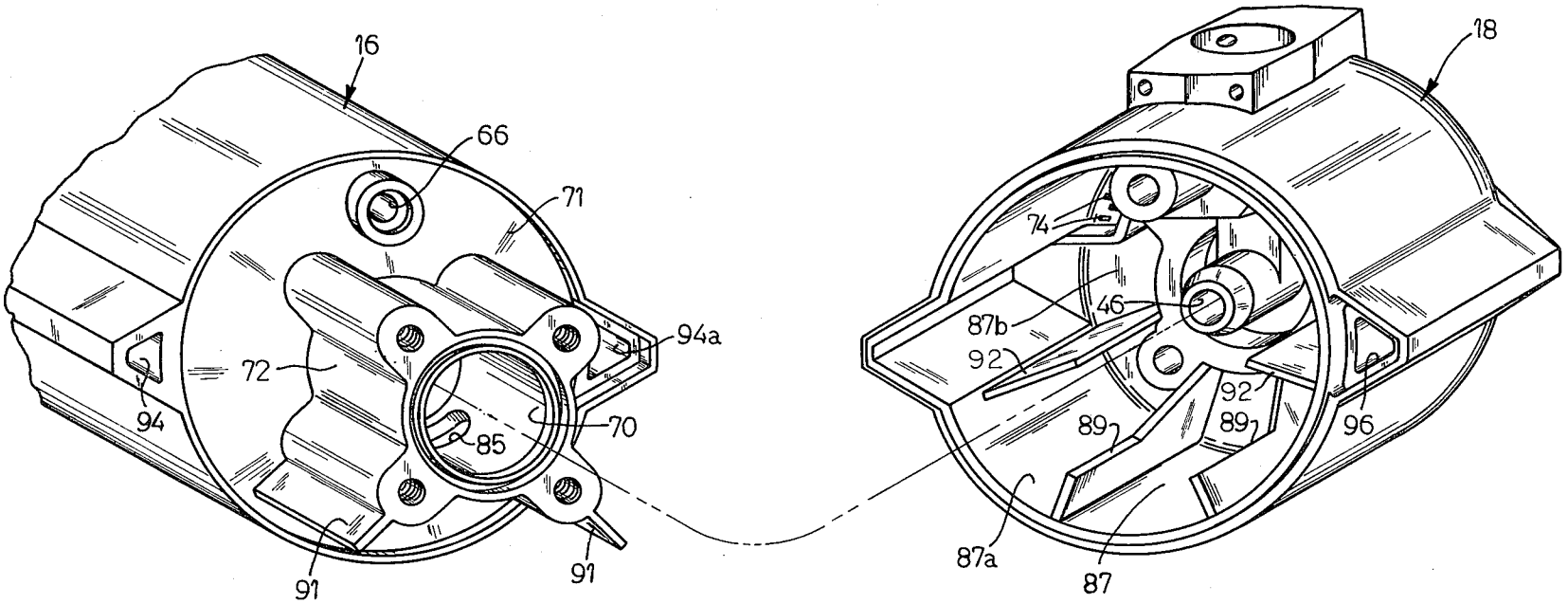
FIG. 7 is an exploded perspective view of the air motor of the fluid actuated hydraulic power unit shown in FIG. 1 and illustrating the expansion chamber and baffles therein.
Figure 8:
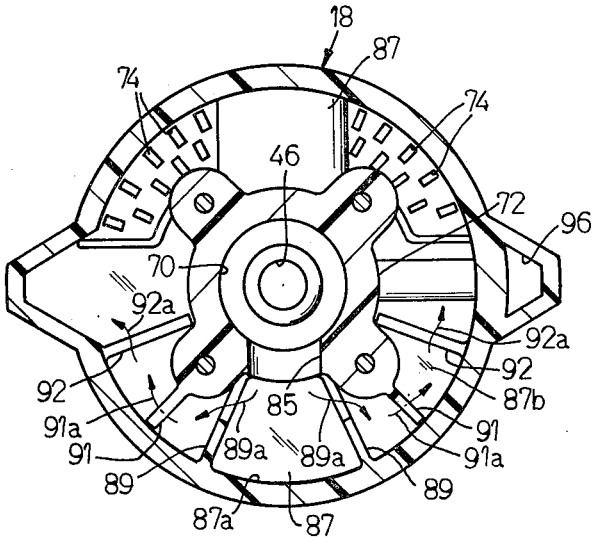
FIG. 8 is a cross-section view taken on line 8—8 of FIG. 5.
Figure 9:
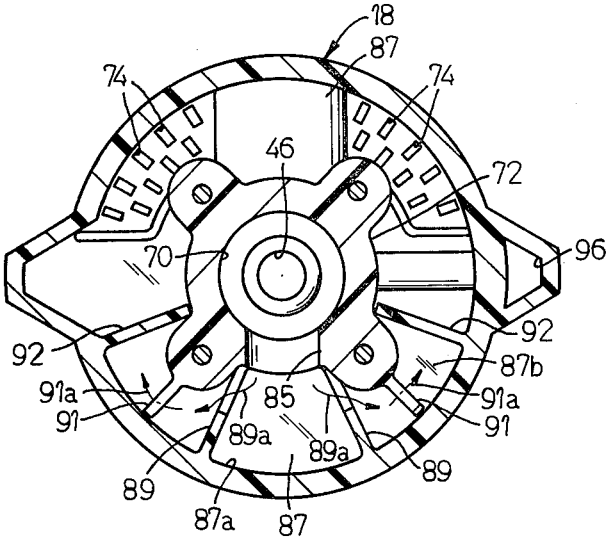
FIG. 9 is a cross-section view taken on line 9—9 of FIG. 5.
Figure 10:
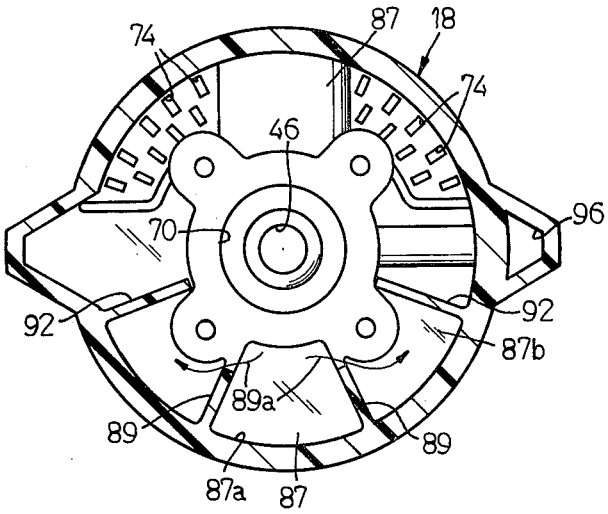
FIG. 10 is a cross-section view taken on line 10—10 of FIG. 5.

An exhaust passage from the chamber 68 to the ambient atmosphere is defined in part by an exhaust port 85 which extends through the wall of the axial projection 72 from valve chamber 70 to a generally annular expansion chamber 87. The annular expansion chamber 87 is defined by a generally cylindrical cavity in the air motor valve block 18 defined by a cylindrical wall 87*a* and an end wall 87*b*, the cylindrical cavity also being bounded by the end wall 71 of the air motor 16 and surrounding the axial projection 72. As best shown in FIG. 7, the expansion chamber 87 includes therein a plurality of opposed circumferentially spaced apart baffles 89 and 92 (FIGS. 4 and 5) which comprise generally planar vanes integrally attached to the cylindrical wall 87*a* and the end wall 87*b* of the air motor valve block 18 and opposed circumferentially spaced apart planar baffles 91 integrally attached to the end wall 71 and the axial projection 72 of the air motor 16, the baffles 89, 92 and 91 each lying in planes extending radially outwardly from the longitudinal axis of the air motor and project into the annular expansion chamber 87. The baffles 91 are shown in FIGS. 7–10 as being positioned so as to be receiveable between the baffles 89 and 92 and in spaced apart relationship from them such that the baffles are arranged in the expansion chamber 87 in such a manner as to disrupt the direction of fluid flow through the expansion chamber but permit free flow of exhaust air from the exhaust port 85, through the expansion chamber 87 and to the atmosphere through a plurality of small exhaust ports 74 in the end wall of the air motor valve block 18. The arrangement of baffles shown in the drawings merely illustrates a preferred embodiment and other arrangements including baffles which may have shapes other than those shown could also be used.

As hereinbefore explained, air or gas driven motor 16 comprises a gas displacement chamber 68; a motor piston 90 in chamber 68 reciprocably movable between two positions, i.e., such as the end of its intake and exhaust strokes; a gas inlet or supply passage 66 in the motor for admitting pressurized gas into chamber 68 to move the piston from one position (end of exhaust stroke) to another (end of intake stroke); a gas exhaust port 85*a* in the motor for allowing exhaust gas to be expelled from chamber 68; and a muffler on the motor and connected to gas exhaust port 85*a* for exhausting gas to a region of pressure relief, such as atmosphere, and for reducing noise generated by such exhaustion. As FIGS. 7, 8, 9, and 10 best show, the muffler comprises annular expansion chamber 87. The first or exhaust port 85 is connected to gas exhaust port 85*a* on the motor 16 for directing pressurized gas into one portion of said annular expansion chamber 87. A plurality of second or small exhaust ports 74 exhaust gas from another portion of the annular expansion chamber to the region of pressure relief outside the muffler. The baffle means located in the annular expansion chamber 87 on opposite sides of first port 85 and between the first port 85 and the second ports 74 are for the purpose of controlling gas flow between the first port 85 and the second ports 74. As hereinbefore explained, passage 94*a* is provided which, when piston 90 moves near the end of its intake stroke, connects gas chamber 68 of motor 16 to a point in annular expansion chamber 87 between the baffle means and the second ports 74. The annular expansion chamber 87 is defined by the pair of spaced apart end walls 87*b* and 71, the circumferential side wall 87*a* extending between the end walls, and the axial projection 72 extending between the end walls. Port 85 is located in annular expansion chamber 87 on one side of projection 72. The plurality of second ports 74 are located in annular expansion chamber 84 on another side of projection 72 in end wall 87*b*. The baffle means comprise a pair of spaced apart first baffles 89 disposed on opposite sides of first port 85, each first baffle 89 extending between the end walls 87*b* and 71 and circumferential side wall 87*a* and extending toward but spaced from projection 72, each first baffle 89 defining a first passage 89*a* near projection 72. A pair of spaced apart second baffles 91 are disposed on opposite sides of and spaced from the pair of first baffles 89, each second baffle 91 extending between projection 72 and circumferential side wall 87*a* and end wall 71 and extending toward but spaced from the other of end wall 87*b*, each second baffle 91 defining a second passage 91*a* near end wall 87*b*. A pair of spaced apart third baffles 92 are disposed on opposite sides of and spaced from second baffles 91, each third baffle 92 extending between projection 72 and circumferential side wall 87*a* and end wall 87*b* and extending toward but spaced from the other end wall 71, each third baffle 92 defining a third passage 92*a* near end wall 71. The passages cause gas entering port 85 to be directed by the baffle means through the first, second, and third passages and out through the second ports 74.

The shuttle valve poppet 48 and the check valve poppet 40 are secured together in axially aligned relationship by a screw 83 extending axially through the shuttle valve poppet 48 and into a threaded bore 40*b* in the check valve poppet 40. Movement of the shuttle valve poppet 48 is thus functional to control axial movement of the check valve poppet 40. The shuttle valve poppet 48 also includes a molded resilient piston portion 75 at one of its ends, the piston portion 75 being axially slideable within the valve chamber 70, and a coil spring 76 is positioned between an annular inwardly projecting flange 78 of the air motor 16 and the piston portion 75. A circular disc-like resilient seal 82 is secured by means of a backup member 82*a* and the screw 83 to the end of the shuttle valve poppet 48 opposite the piston 75 and is normally received against a seat 84 of the annular flange around opening 85*a* to prevent exhaust of air from the chamber 68 through the valve chamber 70. The air motor 16 also includes a cylinder 86 which defines the air motor displacement chamber 68 and which receives an axially movable piston 90 therein. A fluid tight seal is maintained between the cylinder walls of the cylinder 86 and the periphery of the piston 90 by a seal 108.

Figure 3:
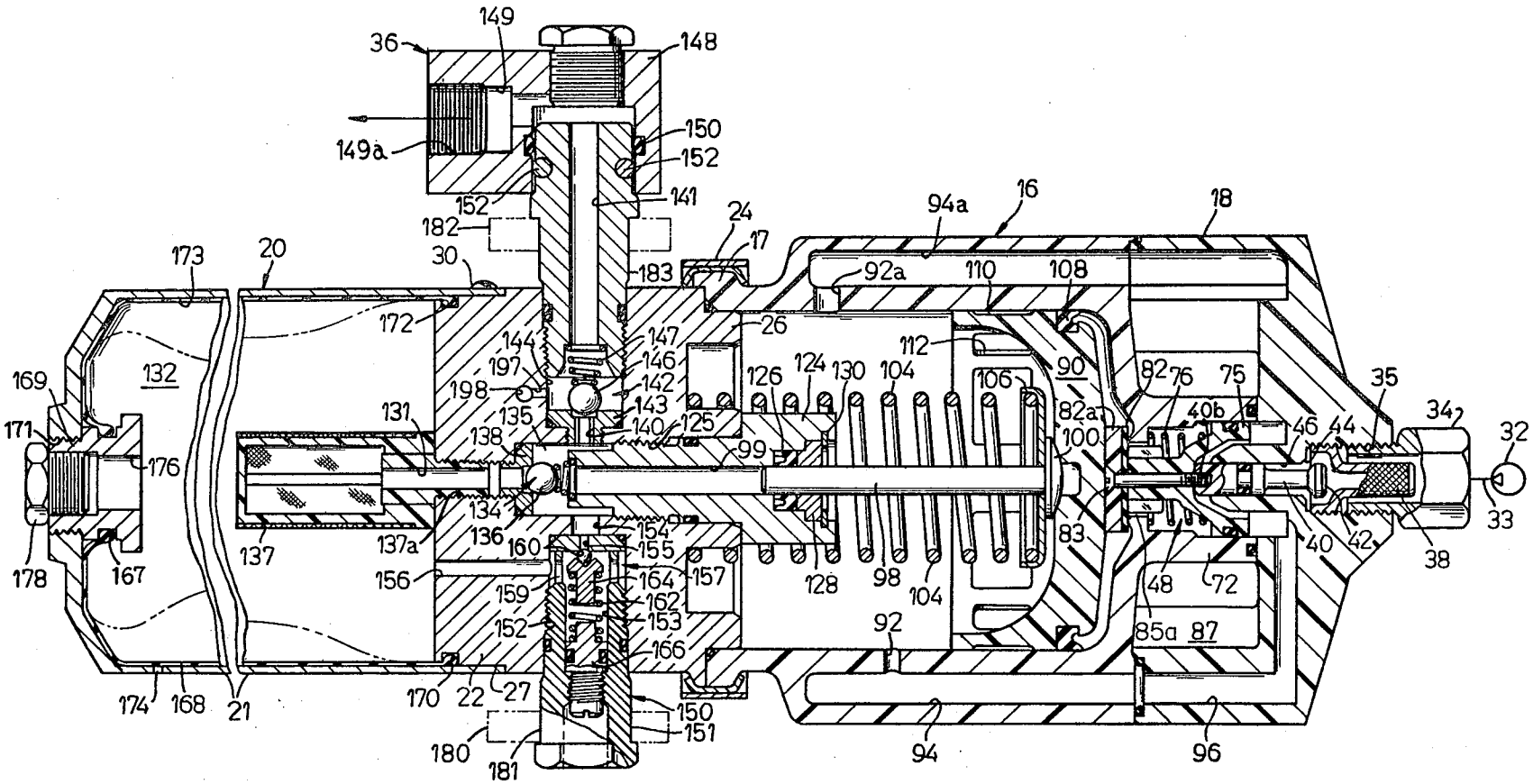
FIG. 3 is a cross-sectional plan view of the power unit shown in FIG. 1 and is taken generally along line 3—3 in FIG. 1.

In order to facilitate reciprocation of the piston 90 in the displacement chamber 68, fluid communication between the ambient atmosphere and that portion of the chamber 68 between the piston 90 and the hydraulic valve block 22 is provided by means of an air passage, shown in FIG. 3, and defined by a port 92*a* through the wall of cylinder 86, and a longitudinally extending passage 94*a* which communicates with the expansion chamber 87. The piston 90 also includes an annular groove 110 surrounding its circumference and a plurality of ports 112 to provide communication between the displacement chamber 68 and the groove 110 and to permit air flow through the port 92*a* as the piston 90 reaches the end of its forward stroke.

The displacement chamber 68 is vented through a port 92 which is remote from the air motor valve block 18 and in communication with the bore 70 through a cylindrical cavity 94, surrounding the cylinder 86, and through a passage 96 in the air motor valve block 18. The port 92 is positioned such that it is adapted to be uncovered by the air motor piston 90 only when the piston 90 reaches the end of its forward stroke.

Seated against the front face of the air motor piston 90 is a small diameter hydraulic fluid pump piston 98 slideably receivable in a cylinder 99 and operable to pump hydraulic fluid through passages in the hydraulic block 22 as will hereinafter more fully appear. The rear of the hydraulic pump piston 98 extends into the air motor displacement chamber 68 and is formed with an enlarged head 100 having a rounded or spherical bearing surface 101 urged against a complementary rounded surface 102 in the face of the piston 90 by a spring 104 compressed between and seated against the rear of the hydraulic valve block 22 and an annular disc 106 supported by the pump piston 98 and adjacent to its head end 100.

The air motor 16 and the air motor valve block 22 of the embodiment of the invention shown in the drawings are each comprised of injection molded plastic. A particular advantage of constructing these components in such a manner is that the bores and passages formed therein as well as the baffles 89, 91 and 92 can be conveniently formed during the molding process avoiding subsequent manufacturing steps.

Air Motor Operation

Figure 4:
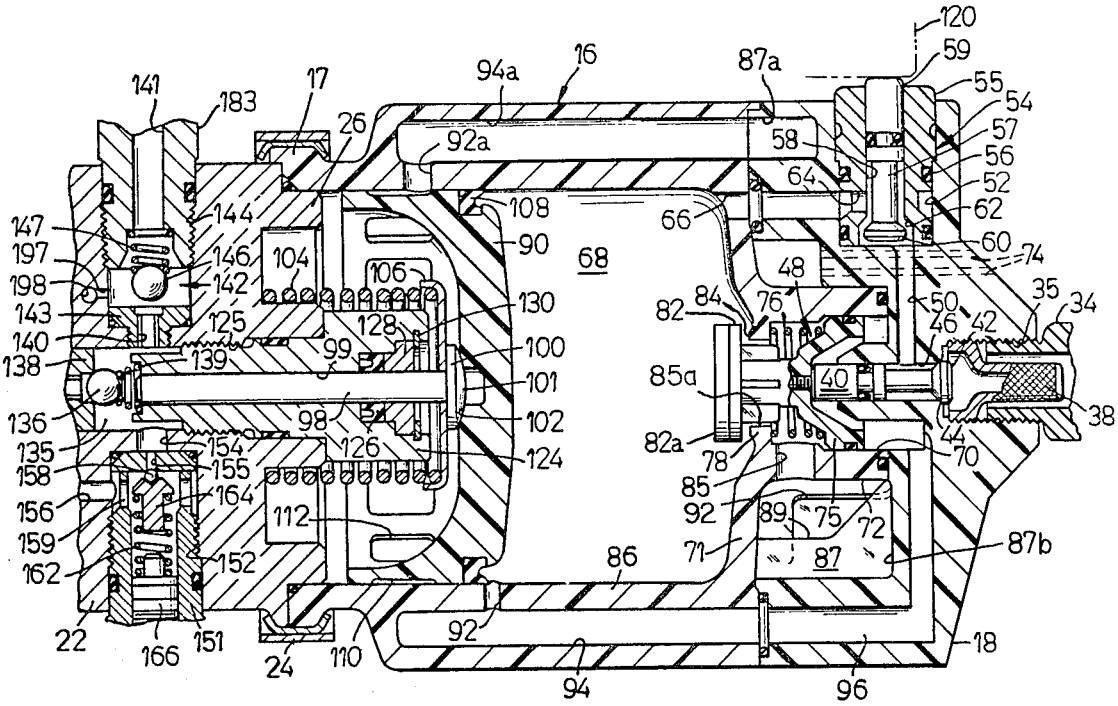
FIG. 4 is a partial cross-sectional plan view similar to FIG. 3 but distorted to show the air motor throttle valve generally in a side elevation cross-section and showing the air piston of the air motor in its fully extended position.

In operation and assuming that the piston 90 begins its reciprocal movement in the position shown in FIG. 3, wherein the force of the spring 104 urges the piston 90 against the shuttle valve poppet 48 thereby causing the check valve poppet 40, secured in abutting relationship thereto by the screw 83, to move axially in bore 46 and the flange 42 thereof to be moved away from the valve seat 44 whereby air can pass through the bore 46 into the passageway 50 (FIG. 4). Movement of the flange 42 away from the valve seat 44 is accompanied by simultaneous engagement of the resilient seal 82 against the seat 84 to close off exhaust flow from chamber 68 to the valve chamber 70. To cause actuation of the air motor, the operator depresses treadle 14 such that the tab 120 (FIG. 6) at the end of the treadle 14 engages the upwardly projecting end 59 of the actuating throttle valve poppet 57 thereby moving the flange 60 away from the valve seat 62 and permitting compressed air to flow from supply passage 50 through passages 64 and 66 into the cylinder cavity 68. The resulting air pressure in cavity 68 will force air piston 90 and the hydraulic fluid piston 98 to the position shown in FIG. 4 thereby providing a hydraulic fluid pumping effect. Such movement of the piston 90 to the end of its stroke will uncover the port 92 thereby permitting compressed air in the displacement chamber 68 to communicate through passages 94 and 96 with the valve chamber 70. The compressed air flowing through passages 94 and 96 into the chamber 70 will cause the piston portion 75 of the shuttle valve poppet 48 to move to the left to the position shown in FIG. 4 against the force of the spring 76, and whereby the check valve poppet 40 is also moved to the left and the flange 42 of the check valve poppet 40 is received against the seat 44 thereby restricting further flow of air through the passage 50 into the air motor 16.

When the shuttle valve piston 75 moves to the position shown in FIG. 4, the disc 82 moves away from the seal 84 thereby permitting the compressed air within the displacement chamber 68 to exhaust through the valve chamber 70 and to flow into the exhaust port 85. The exhaust air then flows through the exhaust port 85 and into the expansion chamber 87, and finally through the plurality of small exhaust passages 74. When the air flows into the expansion chamber 87, the air expands whereby the velocity of the air from the exhaust port 85 is reduced and whereby the noise level produced by the exhaust air is substantially reduced. The spaced apart baffles 89, 92 and 91 in the expansion chamber 87 function to further reduce this noise level by disrupting the direction of air flow through the expansion chamber.

Figure 5:
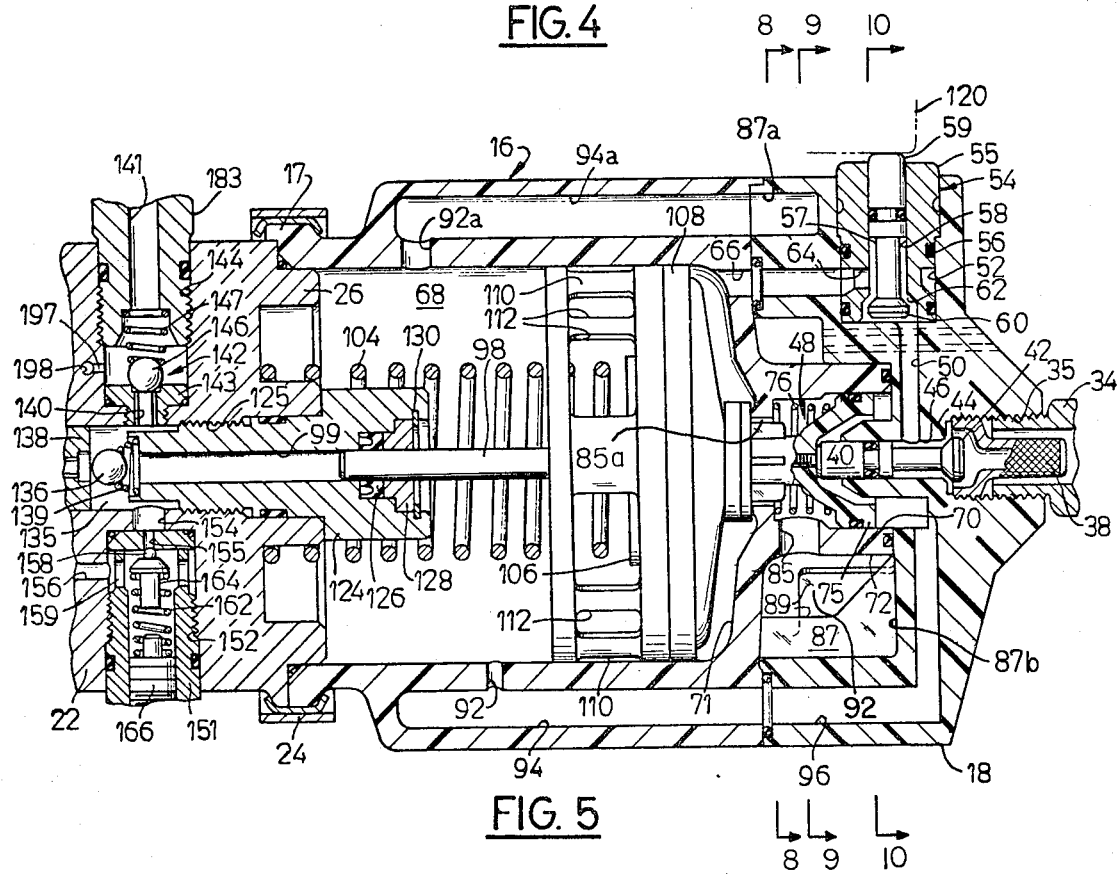
FIG. 5 is a view similar to FIG. 4 but showing the air piston in a retracted position.

As the compressed air is thus exhausted from the displacement chamber 68, the spring 104 forces the piston 90 to return toward its original position as shown in FIG. 3. As shown in FIG. 5, the piston 90 nears its original position, the piston 90 contacts the screw 83 and backup washer 82*a* thereby causing the shuttle valve poppet 48 and the check valve poppet 40 to be forced to the right whereby the flange 42 of the check valve poppet 40 moves away from the seat 44 to permit air flow from the supply source 32 into the passage 50. Furthermore, it will be appreciated that before the piston 90 reaches the end of its return stroke, the flange 42 of the check valve poppet 40 is forced away from the seat 44 sufficiently that air flow through the passage 50 and into the displacement chamber 68 will effect damping of the return stroke of the piston 90. As long as the treadle 14 is depressed and the actuating throttle valve 57 is open, whereby passage 50 and the passages 64 and 66 are in communication, the air motor will continue to pump in a similar fashion as that described above until hydraulic fluid pressure in the cylinder 99 reaches a desired level.

Hydraulic Fluid Pump

In this manner, the hydraulic pump piston 98 is thus caused to reciprocate within the hydraulic pump cylinder 99 by the combined action of the air motor piston 90 and the return spring 104. While the hydraulic pump cylinder 99 may be formed directly in the hydraulic pump valve block 22, it is preferably formed as shown in a readily removable and replaceable cartridge 124 which is threadably received within a bore 125 in the hydraulic valve block 22. Fluid-tight relationship between the hydraulic piston 98 and cylinder 99 is maintained by a seal 126 secured within the cartridge 124 by a backup ring 128 and a snap ring 130. The hydraulic circuitry of the hydraulic pump is encased within the hydraulic valve block 22 (FIG. 3) and comprises in part a suction or supply passage 131 extending from the hydraulic reservoir 132 within the hydraulic reservoir housing 20 past a spring biased ball check valve 134 to the hydraulic pressure chamber 135. The ball check valve 134 includes a ball 136 being seated against a removable seat 138 to close the passage 131 during the forward stroke of the piston 98 and being unseated to open the passage 131 during the return or suction stroke of the piston 98. The ball 136 is biased against the seat 138 by a spring 139 supported by the end of the replaceable cartridge 124. The passage 131 extends through a generally hollow cylindrical hydraulic fluid filter 137 which is threadably secured within a bore **137*a* in the hydraulic valve block 22 and which extends into the reservoir 132. The fluid filter 137 is constructed from a material which permits hydraulic fluid to flow through it but which prevents impurities from entering the pumping chamber 135**.

The hydraulic valve block 22 also includes a high pressure discharge or outlet passageway 141 past a one-way ball check valve 142. The ball check valve 142 is comprised of a valve seat 143 threadably and removably secured within a bore 144 in the hydraulic valve block 22 and a check ball 146 biased against the valve seat 143 by a spring 147. The outlet passage 141 is defined by an axially extending bore 140 through the valve seat 143 and by a longitudinal bore through a cylindrical sleeve 183 which has one end threadably secured within the bore 144 of the valve block 22 and another end supporting a freely rotatable coupling member 148 of the swivel coupling 36. The coupling member 148 includes a stepped central bore 149 in communication with the passage 141, the central bore 149 including a threaded end **149*a* for threadably receiving a hydraulic hose or the like. A fluid-tight seal is maintained between the coupling member 148 and the cylindrical sleeve 183 by a resilient O-ring 150 and relative rotation of the coupling member 148 around the end of the sleeve 183 is facilitated by a pair of retaining pins 152 extending through the coupling member 148 and receivable in a circumferential groove 152*a* in the sleeve 183**.

Also formed in the valve block 22 is a relief valve assembly 150 comprising a generally cylindrical valve housing 151 threadably secured within a bore 152 in the valve block 22, the relief valve assembly 150 intended to provide communication of hydraulic fluid between the hydraulic pressure chamber 135 and the reservoir 132 in the event the fluid pressure in the pressure chamber 135 becomes too great. A port 154 in the valve block 22 extends from the hydraulic pressure chamber 135 into the bore 152 and a similar but transverse bore 156 extends from the bore 152 into the hydraulic reservoir 132. The cylindrical valve housing includes a central chamber 153 in communication with the port 154 through a bore 155 and similarly in communication with transverse bore 156 through a bore 159, however, fluid flow therethrough is prevented by means of a spring biased check valve 157 in the valve housing 151, the check valve 157 being comprised of a ball 158 received against a seat 160 and biased thereagainst by a spring 162 and a ball support member 164. The biasing force of the spring 162 can be adjusted by an accessible screw 166.

The oil in the reservoir 132 is confined within a container formed by a flexible membrane or bladder 168 having a generally cylindrical shape and having one end reversed inwardly and received in fluid-tight relationship in a circumferential groove 167 around a cylindrical plug housing 169 threadably received in a bore 171 in the end of the hydraulic reservoir housing 20. The other end of the container 168 is secured between the wall of the hydraulic reservoir housing 20 and the circumferential periphery of the valve block 22 and includes a circumferential bead 170 received within a circumferential groove 172 around the hydraulic valve block 22. The chamber 173 of the hydraulic reservoir housing 20 supporting the flexible membrane 168 is vented to the atmosphere by means of a vent hole 174. To permit access to the interior of the flexible membrane 168 for re-filling and like purposes, a suitable passageway 176 is provided within the plug housing 169 and is closed by a threaded plug 178.

Figure 1:
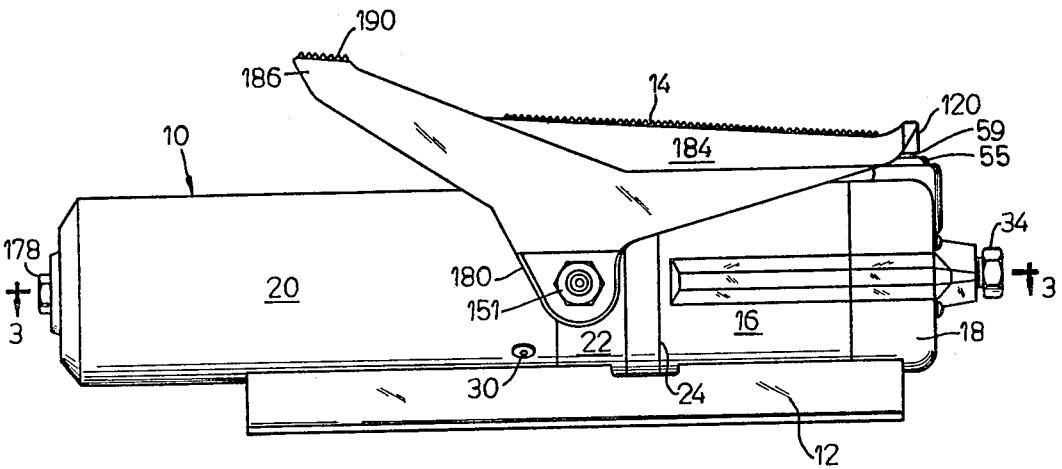
FIG. 1 is a side elevation view of a fluid actuated hydraulic power unit of the present invention.

As previously indicated, the throttle valve 57 is actuated by downward movement of the treadle 14. While the design of the treadle 14 may, of course, be varied, it is preferable that the treadle 14 be pivotably mounted or supported at a point intermediate the ends of the hydraulic pump. Treadle 14 is shown in FIGS. 1 and 2 as including a pair of downwardly extending lobes 180 and 182 at its opposite sides, these lobes including bores therein and being respectively pivotably supported by a cylindrical shaft portion 181 of the cylindrical valve housing 151 and by the cylindrical shaft portion of the cylindrical sleeve 183 whereby the treadle 14 is supported for pivotal movement about a horizontal axis. In its preferred form, the treadle 14 is of integral one-piece construction and has a longitudinally rearwardly extending treadle portion 184 in turn having an end 120 positionable above the upwardly projecting end 59 of the throttle valve 57 to permit actuation of the throttle valve 57 upon downward application of pressure upon treadle portion 184. The treadle 14 also includes a pair of forwardly and upwardly directed side arms 186 and 188 joined at their upper or forward end by a cross piece 190.

Hydraulic Pressure Release Mechanism

Figure 6:
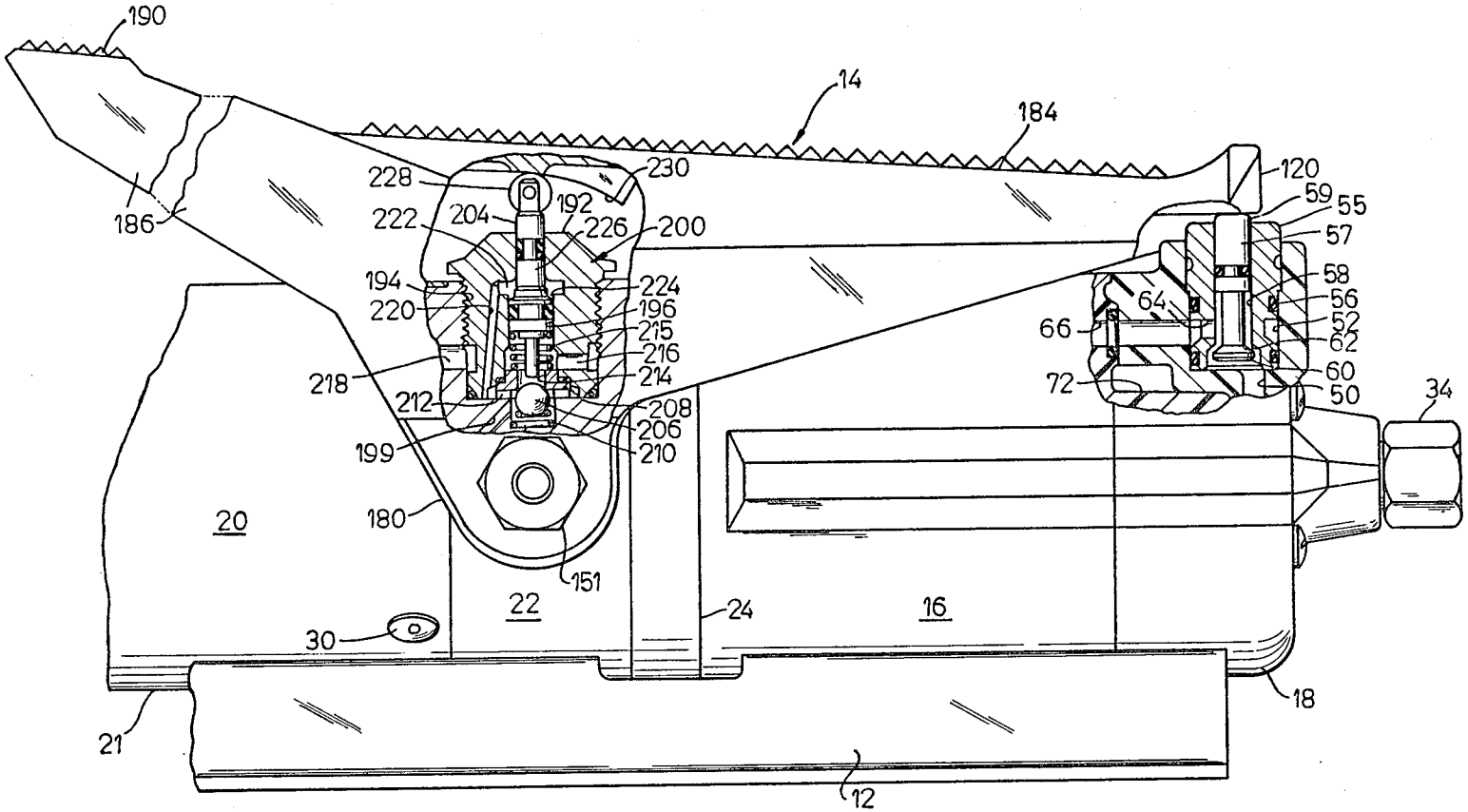
FIG. 6 is an enlarged partial view of the power unit shown in FIG. 1 with portions cut away in the interest of clarity.

To release the pressure developed in the high pressure hydraulic output passage 141 upon completion of the desired work, a release valve assembly 200 is provided, operable for providing fluid communication between the output passage 141 and the hydraulic reservoir 132. A threaded bushing 192 is threadably removably secured within a threaded bore 194 in the hydraulic valve block 22 and the bushing 192 includes a central concentric stepped bore 196 therein communicating with the output passage 141 through a plurality of passages 197 (FIG. 3) 198, and 199 (FIG. 6). The bore 196 houses a reciprocal plunger 204 and a spring biased check ball 206 which is receivable against a removable valve seat 208 and biased there against by a spring 210. The reciprocal plunger 204 is biased away from the ball 206 by a spring 215 in turn supported against valve seat 208. The fluid passage 199 which is in communication with the output passage 141 by means of passages 197 and 198 is also in communication with an annular chamber 212 of the stepped bore 196. Due to the high hydraulic fluid pressures created within the output passage 141 and consequently within the chamber 212, the check ball 206 is forced against the seat 208 with substantial force. It is desireable, however, that the plunger 204 be easily movable to unseat the ball 206 in order to release fluid pressure in the output passage 141, i.e., to permit fluid flow from the chamber 212 through the bore 214 in the seat 208 and consequently through the passage 216 and through a passage 218 into the reservoir 132. To thus facilitate reciprocation of the plunger 204 and movement of the ball 206 away from valve seat 208, a passage 220 is provided connecting the chamber 212 with an annular chamber 222 in the stepped bore 196. Furthermore, the plunger 204 is provided with a stepped configuration and an annular flange 224 adjacent the annular chamber 222. The differences between the cross sectional areas between the upper end 226 and the flange 224 is only slightly less than the effective cross sectional area of the bore 214 and the fluid pressure upon the flange 224 and the upper end 226 will be equal to the fluid pressure upon the ball 206. Thus, the forces on the ball 206 and the plunger 204 will be substantially balanced and the necessary downward force on the plunger 204, which is necessary to force the ball 206 away from the seat 208 to permit fluid flow through the passage 214, will be relatively small. In order to further provide means for easy manipulation of the plunger 204, the upper end of the plunger supports a roller 228 receivable against a curved cam surface 230 comprising an integral configuration of the lower portion of the treadle 14. The curved cam surface 230 is particularly provided with a configuration such that the wedge angle between the cam surface and the roller 228 is very slight when the cam surface 230 and plunger 204 are in the position shown in FIG. 6. Pivotal movement of the treadle 14 in the counterclockwise direction as seen in FIG. 6 will generate a downward force on the plunger 204 whereby the check ball 206 can be biased away from the seat 208 and hydraulic fluid caused to return to the reservoir 132. The cam surface has the particular configuration that as the treadle 14 is further depressed and cam surface 230 moves relative to the plunger 204 the wedge angle increases. This construction facilitates substantial reciprocal travel of the valve plunger 204 once the ball 206 has been unseated thereby facilitating increased fluid flow back to the reservoir once the ball 206 has been unseated.

RESUME

The fluid motor of the present invention provides an improved means for substantially reducing the noise generated by exhaust fluid flowing from the fluid motor and avoids the use of muffling materials thereby avoiding the back pressure in the fluid motor normally caused by use of muffling materials and increasing the efficiency of operation of the motor. The use of muffling materials is avoided since the fluid motor exhaust passage includes an expansion chamber wherein fluid flowing from the motor chamber is allowed to expand thereby reducing the velocity of air exhausted into the atmosphere. The expansion chamber is also provided with baffles disposed therein to disrupt the direction of flow of exhaust fluid and to function to decrease the kinetic energy of the exhaust fluid. In order to further control the noise resulting from the exhaust fluid, the exhaust is conveyed from the expansion chamber to the atmosphere through a plurality of passageways thereby avoiding constriction of the exhaust fluid through a single passage.

A further advantage of the invention described is that the air motor is comprised of molded plastic components, the construction of the fluid motor and fluid motor valve block being such that the expansion chamber can be readily formed and the baffles molded integrally with the fluid motor components.

I claim:

1. In a gas driven motor for driving a hydraulic fluid pump: a gas chamber in said motor; and a muffler for exhausting gas from said gas chamber of said motor to a region of pressure relief and for reducing noise generated by such exhaustion, said muffler comprising:

an annular expansion chamber;

a first port for directing pressurized gas from said gas chamber of said motor into one portion of said annular expansion chamber;

a plurality of second ports for exhausting gas from another portion of said annular expansion chamber to said region of pressure relief;

and baffle means located in said expansion chamber on opposite sides of said first port and between said first port and said second ports for controlling gas flow between said first port and said second ports, said annular expansion chamber being defined by a pair of spaced apart end walls, a circumferential side wall extending between said end walls, and a projection extending between said end walls; said first port being located in said annular expansion chamber on one side of said projection; and said plurality of second ports being located in said annular expansion chamber on another side of said projection, said baffle means comprising:

a pair of spaced apart first baffles disposed on opposite sides of said first port, each first baffle extending between said end walls and from said circumferential side wall and extending toward but spaced from said projection, each first baffle defining a first passage near said projection;

a pair of spaced apart second baffles disposed on opposite sides of and spaced from said pair of first baffles, each second baffle extending between said projection and said circumferential side wall and from one of said end walls and extending toward but spaced from the other of said end walls, each second baffle defining a second passage near the other of said end walls;

and a pair of spaced apart third baffles disposed on opposite sides of and spaced from said second baffles, each third baffle extending between said projection and said circumferential side wall and from the other of said end walls and extending toward but spaced from said one of said end walls, each third baffle defining a third passage near said one of said end walls;

said passages causing gas entering said first port to be directed by said baffle means through said first, second, and third passages and through said second ports.

2. A gas driven motor according to claim 1 wherein said first port is located in said projection and wherein said second ports are located in one of said end walls.

3. In a gas driven motor:

a gas chamber;

a piston in said chamber reciprocably movable between two positions;

a gas inlet in said motor for admitting pressurized gas into said chamber to move said piston from one position to another;

a gas exhaust port in said motor for allowing exhaust gas to be expelled from said chamber;

and a muffler on said motor connected to said gas exhaust port for exhausting gas to a region of pressure relief and for reducing noise generated by such exhaustion, said muffler comprising:

an annular expansion chamber;

a first port connected to said gas exhaust port on said motor for directing pressurized gas into one portion of said annular expansion chamber;

a plurality of second ports for exhausting gas from another portion of said annular expansion chamber to said region of pressure relief;

baffle means located in said expansion chamber on opposite sides of said first port and between said first port and said second ports for controlling gas flow between said first port and said second ports;

and a passage which, when said piston moves near its said other position, connects said gas chamber of said motor to a point in said annular expansion chamber of said muffler between said baffle means and said second ports;

said annular expansion chamber being defined by a pair of spaced apart end walls, a circumferential side wall extending between said end walls, and a projection extending between said end walls; said first port being located in said annular expansion chamber on one side of said projection; and said plurality of second ports being located in said annular expansion chamber on another side of said projection, said first port being located in said projection and said second ports being located in one of said end walls;

said baffle means comprising:

a pair of spaced apart first baffles disposed on opposite sides of said first port, each first baffle extending between said end walls and from said circumferential side wall and extending toward but spaced from said projection, each first baffle defining a first passage near said projection;

a pair of spaced apart second baffles disposed on opposite sides of and spaced from said pair of first baffles, each second baffle extending between said projection and said circumferential side wall and from one of said end walls and extending toward but spaced from the other of said end walls, each second baffle defining a second passage near the other of said end walls;

and a pair of spaced apart third baffles disposed on opposite sides of and spaced from said second baffles, each third baffle extending between said projection and said circumferential side wall and from the other of said end walls and extending toward but spaced from said one of said end walls, each third baffle defining a third passage near said one of said end walls;

said passages causing gas entering said first port to be directed by said baffle means through said first, second, and third passages and through said second ports.

* * * * *